United States Patent [19]

Hatfield

[11] Patent Number: 4,620,325

[45] Date of Patent: Nov. 4, 1986

[54] VISORED CAP AND METHOD FOR MAKING SAME

[76] Inventor: Carl T. Hatfield, P.O. Box 327, Pikeville, Tenn. 37367

[21] Appl. No.: 637,867

[22] Filed: Aug. 6, 1984

[51] Int. Cl.[4] ..... A42B 1/04

[52] U.S. Cl. ..... 2/192; 2/187; 2/195

[58] Field of Search ..... 2/195, 192, 187, 197, 2/200, 198, 199, 175, 177, 201, 202, 203, 204, 205

[56] References Cited

U.S. PATENT DOCUMENTS

| | | | |
|---|---|---|---|
| 1,337,506 | 4/1920 | Chew | 2/187 |
| 1,421,602 | 7/1922 | Spector et al. | 2/201 X |
| 1,787,043 | 12/1930 | Karger | 2/201 |
| 2,133,619 | 10/1938 | Hutton | 2/201 |
| 2,264,594 | 12/1941 | Schuessler | 2/195 |
| 3,041,628 | 7/1962 | Fish et al. | 2/200 X |
| 3,166,766 | 1/1965 | Banello, Jr. | 2/187 |

FOREIGN PATENT DOCUMENTS

| | | | |
|---|---|---|---|
| 1099399 | 1/1968 | United Kingdom | 2/192 |

*Primary Examiner*—Peter Nerbun

*Attorney, Agent, or Firm*—Alan Ruderman

[57] ABSTRACT

A visor sport cap and/or a covering therefor and a method of producing the same, the cap or covering being provided with a head receiving crown constructed from a single piece of material which is cut along specific arcs and shapes and joined together along the cuts. The crown has a first seam extending partly across the top of the front and a second seam extending substantially from the medial point of the first seam to the lower peripheral edge at the rear of the crown, the visor being joined to the crown at the front thereof. In the preferred embodiment a covering for a visor sport cap is formed from a waterproof synthetic plastic material and the joining of the seams are by bonding. The visor covering section is fabricated from two moon shaped pieces joined together about the leading edge and a visor receiving pocket is formed therebetween.

18 Claims, 7 Drawing Figures

VISORED CAP AND METHOD FOR MAKING SAME

BACKGROUND OF THE INVENTION

This invention relates to visored caps and a method for manufacturing such caps and more particularly to a baseball type cap, hereinafter referred to as a "visor sport cap", and a covering therefor having the head conforming crown or helmet portion constructed from a single sheet of material, the material being acted upon in accordance with the novel method to form the crown.

The so called "baseball" type caps are extremely popular and are worn by many sportsmen. Such caps, unless molded, are manufactured from a number of components other than that used in the visor portion. The molded type are generally used merely for protective reasons since they are heavy, non-pervious to the flow of air to the head of the user, and cannot be folded for storage, they are thus not universally utilized—especially by golfers etc. Consequently, the caps, and particularly the crown portion, which are in general use are manufactured from cloth or a plastic mesh type material.

As aforesaid, the crowns of the known caps of this type are fabricated from a number of components in the form of triangular sectors or panels which are sewn or otherwise seamed together. Only the front panel, for aesthetic purposes, is an enlarged panel. Thus, a substantial amount of labor is entailed in the manufacture of these caps resulting in a relatively expensive article compared to the nature of the product. Moreover, with the exception of the water proof covering disclosed in Banello U.S. Pat. No. 3,166,766, no rain protective covering is known for use with such caps. In this patent and in other patents unrelated to visor sport caps such as Guest U.S. Pat. No. 2,677,457 and Kreinik U.S. Pat. No. 2,734,197 which relates to a military or police cap, the coverings, if single piece members are proposed, rely on elastic to roughly shape the covering and the cap. Although water proof coverings for conventional caps have been proposed having the crown portion constructed from a single sheet of material cut and folded to conform to the crown, such as illustrated in Timmons, et al U.S. Pat. No. 2,181,106, such constructions are not known for visor sport caps.

SUMMARY OF THE INVENTION

Consequently, it is a primary object of the present invention to provide a visor sport cap and/or a covering therefor having the head conforming crown portion constructed from a single sheet of material.

It is another object of the present invention to provide a method of constructing a visor sport cap and/or a covering therefor in which the head conforming crown portion is formed from a single sheet of material.

It is a further object of the present invention to provide an inexpensive visor sport cap and/or a water proof covering therefor and a method for manufacturing the same, the cap comprising a single sheet of material cut, folded and joined along edges thereof to form the crown and having a separate bill or visor joined to the front of the crown.

It is a still further object of the present invention to provide an inexpensive visor sport cap and/or a water proof covering therefor and a method for manufacturing the same, the cap comprising a single sheet of material cut, folded and joined along edges thereof to form the crown, the edges being joined so that the front of the crown has a seam only at the top thereof and the remainder of the crown having a single seam extending from and transverse to the first mentioned seam to the lower edge of the rear of the crown, and a visor joined to the lower edge of the front of said crown.

Accordingly, the present invention provides a visor sport cap and/or a covering therefor and a method of producing the same, the cap or covering having a crown portion formed from a single sheet of material which is cut, folded and joined to form a head conforming crown having a first seam extending partly across the top of the front and a second seam extending substantially from the medial point of the first seam to the lower edge at the rear of the crown. The crown portion is thereafter joined to a visor portion at the lower edge of the front of the crown, the visor being fabric having stiffening means in the case of a sport cap, or a material having a visor or bill receiving pocket in the case of a covering for a sport cap.

In the preferred embodiment a water proof covering for sport caps is disclosed comprising a water proof synthetic plastic material and the joining edges are seamed by bonding or heat staking, and the visor portion is joined to the crown by heat staking, a pocket being formed by similarly joining a narrow crescent shaped sector to the lower leading edge of the visor covering. Provision is also made for accepting those popular sport caps having adjustable straps at the rear thereof.

In the method of the present invention material for the crown, whether for a sport cap or for a covering, is cut from a sheet of material into a blank symmetrical about a center line, each half of the blank, which may be cut together from a double thickness of material, has a first arcuately shaped edge extending from the center line to a point remote from said center line, from whence a second arcuately shaped edge extends away from the first edge to a crest point back towards the center line. A third arcuately shaped edge extends from the crest point in the direction toward the center line and the first edge and terminates at a valley spaced from the first edge, and a forth arcuately shaped edge, having substantially the same shape as the third edge, extends from the valley away from the second and third edges and terminates at a terminal point at the center line. Thereafter the second arcuate edge of both halves are brought together and the terminal point is brought to engage the crest point of both halves of the blank, and when so doing the third and fourth arcuate edges of each respective half of the blank are brought into contact. Thereafter the second arcuate edges of both halves are joined together as are the third and fourth edges of each respective half, the terminal points being joined to the crest points. The joining together forms seams at the joined edges which seams may be sewn in the case of fabric or bonded by heat staking in the case of plastic material. In this manner a head conforming crown portion is formed, and the visor portion thereafter may be joined thereto.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
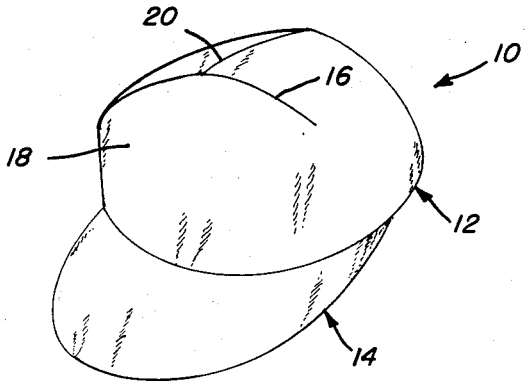
FIG. 1 is a front perspective view illustrating an article such as a sport cap or covering for a sport cap constructed in accordance with the principles of the present invention.

Referring to the drawings and particularly FIG. 1, a cap or covering 10 is illustrated having a crown portion 12 and a bill or visor portion 14. The invention is applicable to either a sport cap or a covering for such a cap, the covering being, for example, a water proof material such as any number of various plastics impervious to water, one such material being polyethylene. For a sport cap per se the material for the crown 12 may be a woven or knitted fabric and/or a plastic mesh material and, as is conventional, the visor may be material encased about a stiffening means such as cardboard and sewn thereto. As illustrated in the drawings the cap or covering, hereinafter referred to and defined as "the article" since, as aforesaid, the invention is applicable to both these items, has a first seam 16 extending partly across the top of the front 18 of the crown and a second seam 20 extending substantially from the medial part of the seam 16 and transversely thereto rearwardly to the rear peripheral edge of the crown, as illustrated in FIG. 7.

Figure 2:
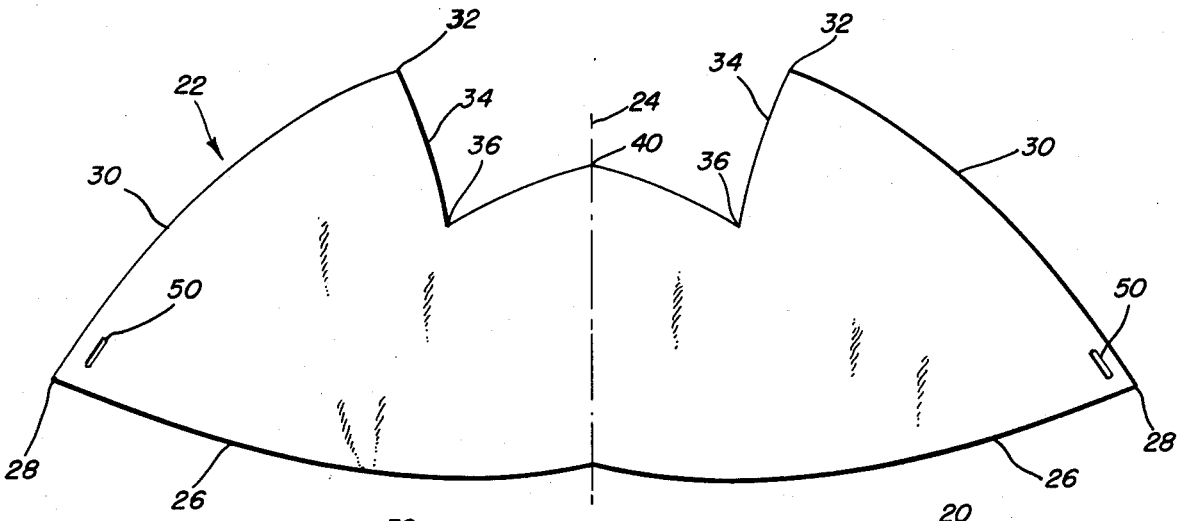
FIG. 2 is a plan view of a blank used to construct the crown portion of the article illustrated in FIG. 1.
Figure 3:
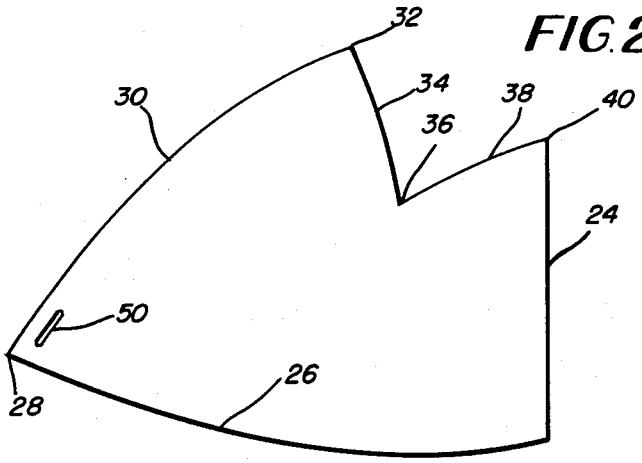
FIG. 3 is a plan view of the blank of FIG. 2 folded in half about the center line thereof.
Figure 5:
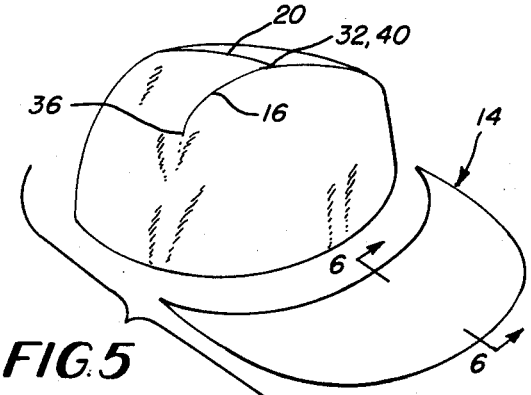
FIG. 5 is a perspective view of a covering for a sport cap illustrating the assembly of the visor portion thereto.
Figure 6:
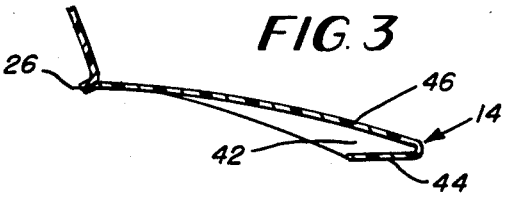
FIG. 6 is a cross sectional view taken substantially along 6—6 of FIG. 5.

The crown 12 comprises a single sheet of material, cut, folded and joined along edges into the appropriate form. A sheet of material is cut into a blank 22 in the shape illustrated in FIG. 2. The blank is symmetrical about a center line 24 and thus, the material may be cut from a double ply of material in the shape illustrated in FIG. 3 which is merely the blank 22 folded about the center line 24. Whether cut from a single ply and folded about the center line 24 or cut from a double ply initially the material eventually attains the shape illustrated in FIG. 3. Thus, FIG. 2 illustrates and designates by the same reference numerals edges and points which are identical on each half of the blank since they are mirror images of each other about the center line 24. Thus, each half of the blank of FIG. 2 has a first edge 26 which eventually forms the lower head receiving peripheral edge of the crown extending from the center line 24. This edge 26 is preferably of a slight convex arcuate shape since a better fit is provided and therefore superior results attained than when a straight edge is provided. However, it should be understood that the arc of each edge 26 has a very large radius.

Figure 7:
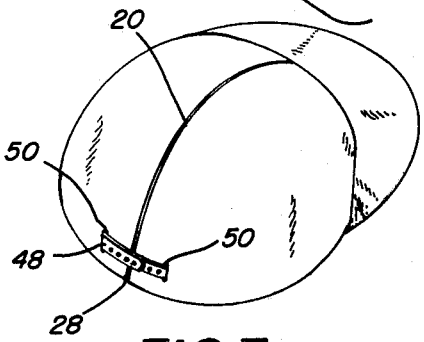
FIG. 7 is a rear perspective view of the covering.

The edge 26 extends from the center line 24 to a point 28 most remote from the center line, the point 28 eventually forming the rearmost bottom edge of the crown as illustrated in FIG. 7. From the point 28 the blank includes a second edge 30 which has a convex arcuate shape extending from the point 28 to another point 32 which forms the crest or maximum width of the blank from the edge 26 and eventually is at the junction of the seams 16 and 20.

From the crest point 32 the blank 22 includes a third convex arcuate edge 34, the edge 34 extending from the point 32 downwardly toward the edge 26 and inwardly toward the center line 24 and terminates at a point 36 which forms a valley in the blank. From the point 36 the blank has an edge 38 which comprises a convex arcuate shape and extends upwardly back toward the center line terminating at a point 40 on the center line. The shape of the edges 34 and 38 are substantially the same as are the lengths thereof so that when the crown is formed the points 36 form respective terminuses of the seam 16 and the edges 34 and 38 of each half of the blank forms a respective half of the seam 16, the point 40 being joined to both of the points 32.

Figure 4:
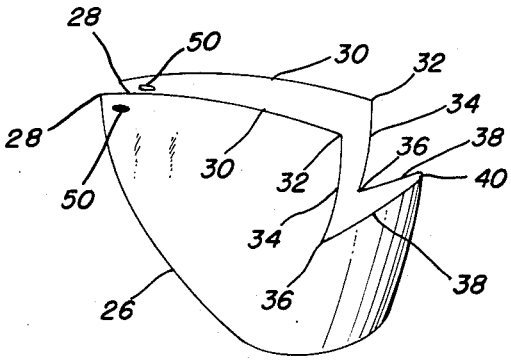
FIG. 4 is a perspective view of a folding step in the process of forming the crown.

After the blank 22 is cut as illustrated, it is thereafter folded or formed as illustrated in FIG. 4. Thus, the edges 30 of each half are brought together from the point 28 to the points 32 while the edges 26 are separated and maintained separate. The pair of edges 30 may be joined to form the seam 20. Although the points 32 are joined together, the edges 34 of each half are separated and the point 40 is brought into abutting engagement with and joined to the points 32. In view of the shape and size of the edges 34 and 38, when the point 40 is brought to the points 32 each edge 38 of a respective half of the blank is brought into overlying abutting relationship with the respective edge 34 and are joined thereto. Thus, the edges 34 and 38 of each half of the blank is formed into half of the seam 16.

If the crown 12 formed as described is for a sport hat having fabric material the seams 20 and 16 would be sewn and the visor attached thereto accordingly. However, if the crown is for a waterproof covering the seams would be bonded by heat staking or a similar process and the visor also so attached. In this latter case the visor 14 will also have a pocket 42 which may be formed by a small crescent shaped sector 44 heat staked to the front edge of the upper material 46, the latter being attached at its other end to the front edge 26 of the crown. Thus, the crown of the covering may be placed about the crown of a sports cap and the visor of the sport cap inserted into the pocket 42 of the covering. Moreover, to accommodate those sport caps having adjustment strapping 48, as illustrated in FIG. 7, the rear of the crown may have strap receiving slots 50, which together with the pocket 42 aids in securely holding the covering to the cap.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An article of manufacture in the form of a sport cap head covering having a head receiving crown and a visor fastened to the head receiving peripheral edge of the crown at a front portion thereof, said crown comprising a single sheet of material cut, folded and joined to form only two seams therein, a first of said seams extending between terminal points sidewise partly across the top of the crown at the front thereof, and the second of said seams commencing at and extending substantially normal to said first seam from a medial portion of the first of said seams without projecting frontwardly of said first of said seams and terminating at the peripheral edge at the rear of the crown, only respective ends of said first of said seams terminating at the terminal points.

2. An article of manufacture as recited in claim 1, wherein said head covering comprises a covering for a sport cap, said crown comprising a flexible synthetic plastic water proof material.

3. An article of manufacture as recited in claim 2, wherein said visor comprises a sheet of material joined to said crown and extending in bill fashion to a leading edge, another sheet of material joined to said leading edge at the underside thereof and extending toward said crown and spaced therefrom to define a pocket for receiving the visor of a cap to be covered thereby.

4. An article of manufacture as recited in claim 3, including a pair of spaced apart slots at the rear of the crown remote from said visor for receiving adjustment strap means of a sport cap.

5. A method of forming the head receiving crown of a visor type sport cap or the like from a single sheet of material, said method comprising: cutting a blank of said material symmetrical about a center line, said blank at each side of said center line being cut along a first arcuately shaped edge extending from the center line to a point remote from said center line, from said point along a second arcuately shaped edge away from said first edge toward said center line to define a crest point, said crest point being that portion of the blank most remote from said first edge, said blank being cut from said crest point to a valley along a third arcuately shaped edge toward said first edge and said center line, and from said valley point along a fourth arcuately shaped edge away from said first edge to a terminal point on said center line; joining the second arcuately shaped edge of half of said blank to the other second arcuately shaped edge to form a first seam; joining the terminal point to the crest points; and joining the third to the fourth arcuately shaped edges of each half of each blank to form a second seam substantially normal to said first seam.

6. In the method as recited in claim 5, wherein each arcuately shaped edge is convex.

7. In the method as recited in claim 5, wherein said joining comprises forming seams.

8. In the method as recited in claim 6, wherein said joining comprises forming seams.

9. In the method as recited in claim 6, wherein said material is waterproof synthetic plastic and said joining comprises bonding by heat staking.

10. In the method as recited in claim 5, wherein said third and fourth edges are substantially the same size and shape.

11. In the method as recited in claim 10, wherein each arcuately shaped edge is convex.

12. In the method as recited in claim 11, wherein said joining comprises forming seams.

13. In the method as recited in claim 11, wherein said material is waterproof synthetic plastic and said joining comprises bonding by heat staking.

14. A method of forming a waterproof covering for a sport cap having a head receiving crown and a visor, said method comprising forming a crown from a single sheet of material and joining a visor covering thereto, said crown covering being formed by the steps comprising: cutting a blank of said material symmetrical about a center line, said blank at each side of said center line being cut along a first arcuately shaped edge extending from the center line to a point remote from said center line, from said point along a second arcuately shaped edge away from said first edge toward said center line to define a crest point, said crest point being that portion of the blank most remote from said first edge, said blank being cut from said crest point to a valley along a third arcuately shaped edge toward said first edge and said center line, and from said valley point along a fourth arcuately shaped edge away from said first edge to a terminal point on said center line; joining the second arcuately shaped edge of half of said blank to the other second arcuately shaped edge to form a first seam; joining the terminal point to the crest points; and joining the third to the fourth arcuately shaped edges of each half of each blank to form a second seam substantially normal to said first seam.

15. In the method of forming a waterproof covering for a sport cap as recited in claim 14, wherein each arcuately shaped edge is convex.

16. In the method of forming a waterproof covering for a sport cap as recited in claim 15, wherein said third and fourth edges are substantially the same size and shape.

17. In the method of forming a waterproof covering for a sport cap as recited in claim 16, wherein said visor covering is formed by cutting a first crescent shaped sector of substantially the same size and shape of the visor of said sport cap, forming a second and smaller crescent shaped sector having the same size and shape of the larger diameter edge of the first sector but of a smaller width, joining the first and second shaped sectors only along the larger diameter edges, and joining the smaller diameter edge of the first sector to a portion of the first arcuately shaped edge of the crown, whereby a visor receiving pocket is formed between the first and second crescent shaped sectors.

18. In the method of forming a waterproof covering for a sport cap as recited in claim 17, wherein said portion includes the center line of said crown and an equal amount on each side thereof.

* * * * *